US011135610B2

(12) United States Patent
Norman et al.

(10) Patent No.: US 11,135,610 B2
(45) Date of Patent: Oct. 5, 2021

(54) RETENTION AND DISASSEMBLY OF HVLP SPRAY CAP ASSEMBLY

(71) Applicant: Graco Minnesota Inc., Minneapolis, MN (US)

(72) Inventors: Kirsten N. Norman, Oak Grove, MN (US); Craig J. Wojciechowski, Foley, MN (US); Diane L. Olson, Elk River, MN (US); Dale C. Pemberton, Big Lake, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 150 days.

(21) Appl. No.: 15/876,428

(22) Filed: Jan. 22, 2018

(65) Prior Publication Data

US 2018/0207662 A1 Jul. 26, 2018

Related U.S. Application Data

(60) Provisional application No. 62/449,086, filed on Jan. 22, 2017.

(51) Int. Cl.

| | |
|---|---|
| ***B05B 13/02*** | (2006.01) |
| ***B05B 11/00*** | (2006.01) |
| ***B05B 7/00*** | (2006.01) |
| ***B05B 1/30*** | (2006.01) |
| ***B05B 7/24*** | (2006.01) |

(52) U.S. Cl.

CPC ..... *B05B 13/0278* (2013.01); *B05B 1/3006* (2013.01); *B05B 7/0043* (2013.01); *B05B 7/0081* (2013.01); *B05B 7/2416* (2013.01); *B05B 7/2437* (2013.01); *B05B 11/3069* (2013.01)

(58) Field of Classification Search

CPC . B05B 13/0278; B05B 1/3006; B05B 7/0043; B05B 7/0081; B05B 7/2416; B05B 7/2437; B05B 11/3069; F16F 1/122; F16F 1/125; F16F 3/04; B65H 2402/542; B81B 2203/0163

See application file for complete search history.

(56) References Cited

U.S. PATENT DOCUMENTS 1,608,438 A 11/1926 Shelburne
1,906,975 A 5/1933 Larson
(Continued)

OTHER PUBLICATIONS

Extended European Search Report for EP Application No. 18152756.5, dated Jun. 18, 2018, 12 Pages.
(Continued)

*Primary Examiner* — Tuongminh N Pham
(74) *Attorney, Agent, or Firm* — Kinney & Lange, P.A.

(57) ABSTRACT

A spray gun includes a gun body having a front body portion and a spray cap assembly attached to the front body portion of the gun body. The spray cap assembly includes a nozzle assembly and a spray cap positioned over the nozzle assembly. The nozzle assembly includes a nozzle piece configured to attach to the front body portion of the gun body and an air flow guide surrounding the nozzle piece. The spray cap interfaces with the air flow guide. The air flow guide is configured to engage with the nozzle piece so that the air flow guide is prevented from moving past the nozzle piece.

19 Claims, 6 Drawing Sheets

(56) References Cited

U.S. PATENT DOCUMENTS

| | | | | |
|---|---|---|---|---|
| 5,102,051 | A * | 4/1992 | Smith | B05B 7/0081 239/297 |
| 5,209,405 | A | 5/1993 | Robinson et al. | |
| 5,279,461 | A * | 1/1994 | Darroch | B05B 7/0081 239/290 |
| 5,794,743 | A * | 8/1998 | Pradel | B60G 21/0555 188/322.16 |
| 9,327,300 | B2 | 5/2016 | Chen et al. | |
| 2005/0242207 | A1* | 11/2005 | Tejeda | B05B 7/0815 239/346 |
| 2005/0284963 | A1 | 12/2005 | Reedy | |
| 2006/0082037 | A1* | 4/2006 | Al-Dahhan | B60G 11/54 267/179 |
| 2008/0272213 | A1 | 11/2008 | Ting | |
| 2010/0206963 | A1* | 8/2010 | Huang | B05B 7/0815 239/290 |
| 2015/0174597 | A1* | 6/2015 | Shih | B05B 7/0815 239/418 |

OTHER PUBLICATIONS

First Chinese Office Action for Chinese Patent Application No. 2018100605676, dated Jan. 21, 2020, 20 pages.
Second Chinese Office Action for Chinese Patent Application No. 2018100605676, dated Jan. 25, 2021, 22 pages.

* cited by examiner

RETENTION AND DISASSEMBLY OF HVLP SPRAY CAP ASSEMBLY

CROSS-REFERENCE TO RELATED APPLICATION(S)

This application claims the benefit of U.S. Provisional Application No. 62/449,086 filed Jan. 22, 2017 for "RETENTION AND DISASSEMBLY OF HVLP SPRAY CAP ASSEMBLY" by Kirsten N. Norman, Craig J. Wojciechowski, Diane L. Olson, and Dale C. Pemberton, which is fully incorporated by reference herein.

BACKGROUND

The present disclosure relates generally to spray systems, and in particular, to high-volume low-pressure (HVLP) spray systems.

HVLP spray systems generally have air sources that produce a high volume of airflow at a low pressure. Air flows through a spray gun of an HVLP spray system to propel a sprayable fluid from the gun and onto a target substrate for painting, staining, or coating. HVLP spray systems can minimize overspray and maximize transfer efficiency while being highly controllable. Spray guns of HVLP spray systems generally include spray cap assemblies. Spray cap assemblies can be difficult to disassemble in the field due to the number of loose components that make up the assembly.

SUMMARY

A spray gun includes a gun body having a front body portion and a spray cap assembly attached to the front body portion of the gun body. The spray cap assembly includes a nozzle assembly and a spray cap positioned over the nozzle assembly. The nozzle assembly includes a nozzle piece configured to attach to the front body portion of the gun body and an air flow guide surrounding the nozzle piece. The spray cap interfaces with the air flow guide. The air flow guide is configured to engage with the nozzle piece so that the air flow guide is prevented from moving past the nozzle piece.

A spray gun of a high-volume low-pressure spray system includes a gun body having a front body portion and a spray cap assembly attached to the front body portion of the gun body. The spray cap assembly includes a nozzle assembly and a spray cap positioned over the nozzle assembly and removably attached to the front body portion. The nozzle assembly includes a nozzle piece partially positioned in the front body portion of the gun body and an air flow guide surrounding the nozzle piece and located in the front body portion. The spray cap interfaces with the air flow guide. Removal of the spray cap alone does not allow the air flow guide to be removed from the front body portion of the gun body.

A method for disassembling a spray cap assembly of a spray gun of a high-volume low-pressure spray system includes removing a retaining ring from a front body portion of a gun body of the spray gun and removing a spray cap from the front body portion of the gun body while leaving a nozzle piece retained to the gun body, wherein the nozzle piece also retains an air flow guide to the gun body.

DETAILED DESCRIPTION

In general, the present disclosure describes a spray gun of a high-volume low-pressure (HVLP) spray system that has a spray cap assembly including a nozzle assembly with an air flow guide that cannot slide over the nozzle piece, which prevents the air flow guide and a spring from falling out of the gun when the spray cap is removed. Additionally, the air flow guide is removable from the nozzle piece, and the spring is removable from the air flow guide. As a result, the spray cap assembly of the spray gun is easier to disassemble, such as for replacing or cleaning parts of the spray gun.

Figure 1:
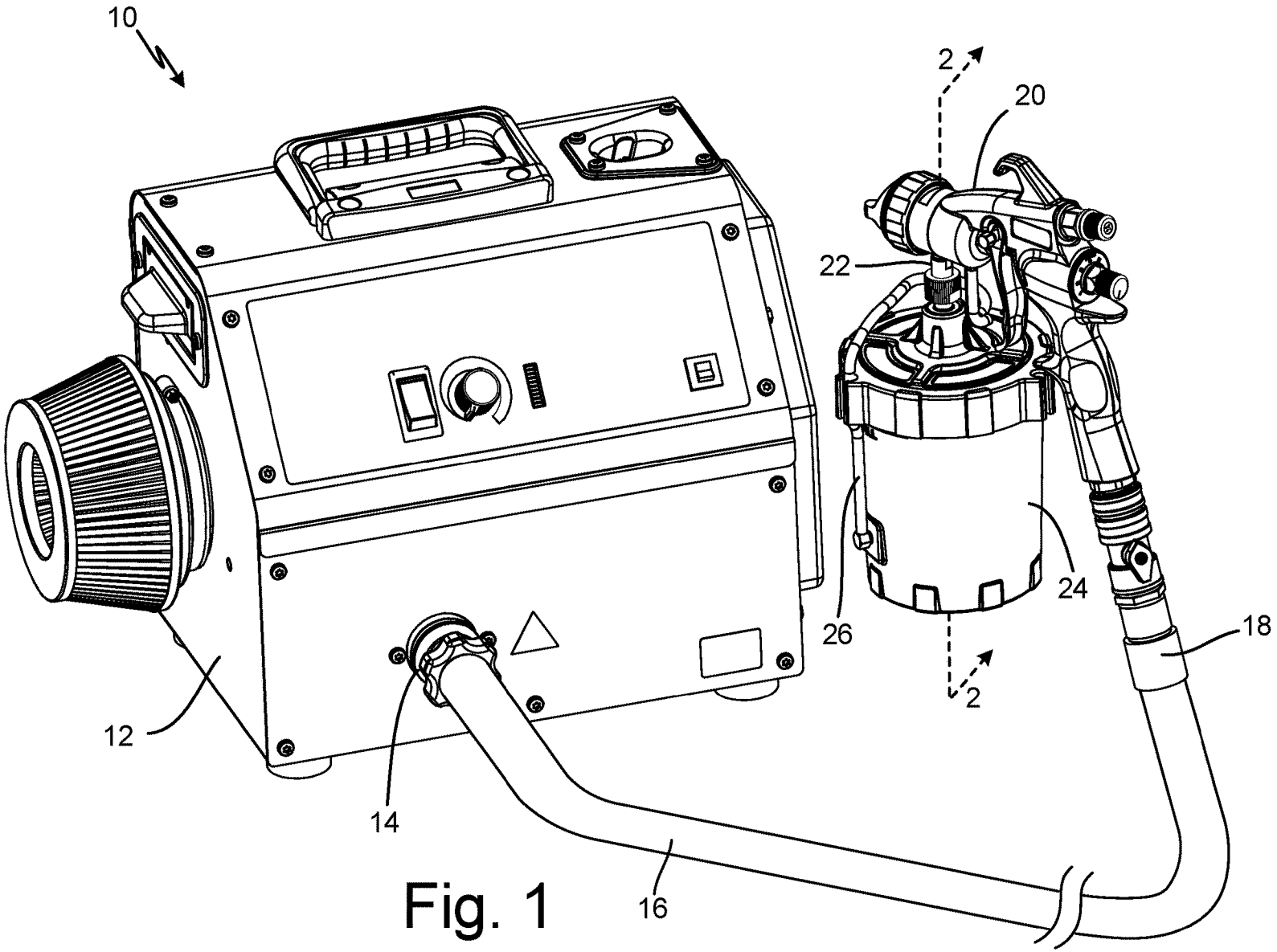
FIG. 1 is an isometric view of an HVLP spray system.

FIG. 1 is an isometric view of HVLP spray system 10. HVLP spray system 10 includes air control housing 12, fitting 14, hose 16, fitting 18, spray gun 20, neck 22, fluid reservoir 24, and tube 26.

Air control housing 12 is a housing that contains various components for providing and controlling pressurized air suitable for HVLP spraying. Air control housing 12 may be a metal or plastic box. Fitting 14 has a first end attached to air control housing 12 and a second end attached to a first end of hose 16. In alternate embodiments, fitting 14 may be attached to a first end of an intermediary fitting that has a second end attached to hose 16. A second end of hose 16 is attached to fitting 18. Fitting 18 has a first end attached to the second end of hose 16 and a second end attached to spray gun 20. In alternate embodiments, the second end of fitting 18 is attached to a first end of an intermediary fitting that has a second end attached to spray gun 20. Neck 22 is hollow and has a first end attached to spray gun 20 and a second end attached to fluid reservoir 24. Fluid reservoir 24 has a space that may contain paint, water, oil, stains, finishes, coatings, solvents, solutions, or any other suitable sprayable fluid. Tube 26 has a first end attached to spray gun 20 and a second end attached to fluid reservoir 24.

Air control housing 12 encloses a mechanism, such as a turbine, for supplying pressurized air to HVLP spray system 10. The turbine may include an impeller rotated by an electric motor. Rather than a turbine, air control housing 12 may enclose and use a compressor, a fan, a pump, or any other suitable mechanism capable of blowing or otherwise pressurizing air to provide pressurized air to HVLP spray system 10. The turbine pushes pressurized air into fitting 14. The air is conveyed through fitting 14, through hose 16, and through fitting 18 into spray gun 20. The air flow can be up to approximately 50 cubic feet per minute. Spray gun 20 routes some of the pressurized air through tube 26 to fluid reservoir 24. The pressurized air supplied to fluid reservoir 24 forces fluid, such as paint, in fluid reservoir 24 up through neck 22, and into spray gun 20. Spray gun 20 also routes some of the pressurized air through spray gun 20. The air flowing through spray gun 20 at high volume and low pressure propels the paint in spray gun 20 out of spray gun 20 as an atomized spray, which can be directed onto a target substrate.

HVLP spray system 10 can be used to paint, stain, or coat various surfaces. Because HVLP spray system 10 produces a high volume of airflow at a low pressure, HVLP spray system 10 is ideal for minimizing overspray and maximizing transfer efficiency while being highly controllable.

Figure 2:
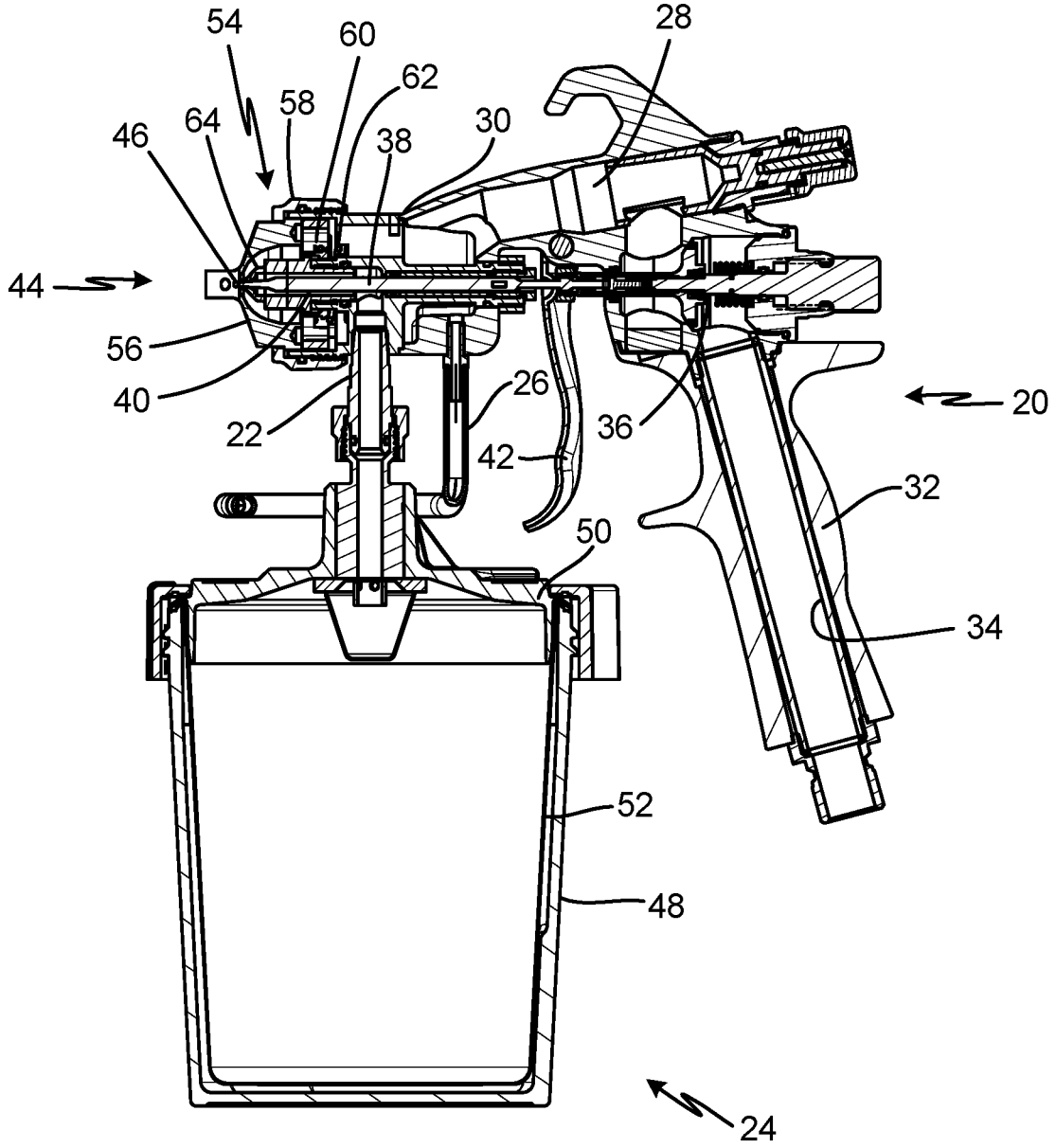
FIG. 2 is a cross-sectional view of a spray gun and a fluid reservoir of the HVLP spray system taken along line 2-2 of FIG. 1.

FIG. 2 is a cross-sectional view of spray gun 20 and fluid reservoir 24 of HVLP spray system 10 taken along line 2-2 of FIG. 1. HVLP spray system 10 includes spray gun 20, neck 22, fluid reservoir 24, and tube 26. Spray gun 20 includes gun body 28 (which has front body portion 30), handle 32, channel 34, first valve 36, needle 38, paint channel 40, trigger 42, spray cap assembly 44, and second valve 46. Fluid reservoir 24 includes cup 48, lid 50, and liner 52. Spray cap assembly 44 includes nozzle assembly 54, spray cap 56, and retaining ring 58. Nozzle assembly 54 includes air flow guide 60, spring 62, and nozzle piece 64.

HVLP spray system 10 is the same as described in reference to FIG. 1. Gun body 28 makes up a body portion of spray gun 20. Front body portion 30 is a front portion of gun body 28. Handle 32 is connected to a bottom portion of gun body 28 adjacent a back end of gun body 28. Channel 34 extends through handle 32 from a bottom end of handle 32 to a top end of handle 32. Channel 34 is in fluid communication with an interior of gun body 28. First valve 36 is between channel 34 and the interior of gun body 28. First valve 36 is adjacent needle 38. Needle 38 is within gun body 28 and extends through gun body 28 from the back of gun body 28 to the front body portion 30 of gun body 28. Needle 38 extends into paint channel 40, which is a passageway located within front body portion 30. Needle 38 is an elongated metal rod. Paint channel 40 is coaxial with needle 38. Trigger 42 is connected to needle 38. Spray cap assembly 44 is connected to gun body 28 at a front end of front body portion 30. Spray cap assembly 44 is adjustable and removable from front body portion 30 of gun body 28. Second valve 46 is adjacent a front end of needle 38.

Fluid reservoir 24 has cup 48 for holding fluid. Cup 48 is rigid, and may be formed from a polymer or a metal. Cup 48 has a closed end and an open end. Lid 50 is attached to the open end of cup 48. Lid 50 is also attached to neck 22. Liner 52 is disposed within cup 48, and lid 50 fits over liner 52 and cup 48. Liner 52 is collapsible, and can contain sprayable fluid, such as paint. A sealed space exists between an inside of cup 48 and an outside of liner 52. Tube 26 is connected to fluid reservoir 24 and provides a passageway for compressed air to reach fluid reservoir 24. Compressed air in fluid reservoir 24 is contained in the sealed space between cup 48 and liner 52.

In alternate embodiments, fluid reservoir 24 does not include liner 52. In such embodiments, paint may reside directly in cup 48. Further, in such embodiments, cup 48 may be inverted such that cup 48 is positioned above gun body 28 in a cup-over arrangement, where the flow of paint from fluid reservoir 24 is gravity-assisted (and does not require a supply of pressurized air in cup 48). In a gravity-assisted configuration, HVLP spray system 10 may not include tube 26 and fluid reservoir 24 may not include liner 52.

Spray cap assembly 44 has nozzle assembly 54 removably attached to front body portion 30 of gun body 28. Spray cap 56 is removably attached to front body portion 30 and positioned over nozzle assembly 54 such that nozzle assembly 54 is between spray cap 56 and front body portion 30. Spray cap 56 is partially positioned in front body portion 30, and is connected to front body portion 30 via retaining ring 58. As such, spray cap 56 is forward, or downstream, of nozzle assembly 54. Spray cap 56 is movable, or adjustable, within front body portion 30. Retaining ring 58 is positioned around spray cap 56. Retaining ring 58 is positioned on front body portion 30 of gun body 28 such that retaining ring 58 surrounds a back portion of spray cap 56 and an outer surface of the front of front body portion 30.

Air flow guide 60 of nozzle assembly 54 is located within front body portion 30 of gun body 28. A front, or downstream, end of air flow guide 60 interfaces with a back end of spray cap 56. A back, or upstream, end of air flow guide 60 is removably attached to, or selectively detachable from, a front portion of spring 62. Spring 62 is also located within front body portion 30 of gun body 28. Nozzle piece 64 is coaxial with air flow guide 60 and spring 62. Air flow guide 60 surrounds nozzle piece 64. Nozzle piece 64 is removably attached to, or selectively detachable from, front body portion 30 of gun body 28 and secures air flow guide 60 and spring 62 to the front end of front body portion 30 of gun body 28. More specifically, a back end of nozzle piece 64 has threading such that the back end of nozzle piece 64 is threaded into paint channel 40 at front body portion 30, such that nozzle piece 64 is partially threaded into front body portion 30 of gun body 28. As such, nozzle piece 64 is partially positioned in front body portion 30. A front end of nozzle piece 64 extends into a central space at a back end of air flow guide 60. Needle 38 extends through spring 62, air flow guide 60, and nozzle piece 64. Second valve 46 is formed by a front end of needle 38 interfacing with nozzle piece 64 within nozzle assembly 54.

Pressurized air is introduced to spray gun 20 through a port on the bottom end of handle 32 and flows through channel 34 to the top end of handle 32. Needle 38 seals first valve 36 and second valve 46. Compressing, or pulling, trigger 42 causes rearward movement of needle 38, changing first valve 36 from a closed position to an open position. When first valve 36 is open, pressurized air flows from channel 34 into the interior of gun body 28. Pressurized air flows from a back portion of gun body 28 into front body portion 30 of gun body 28. Pressurized air entering front body portion 30 may be, for example, approximately 4 pounds per square inch to approximately 10 pounds per square inch. Some of the pressurized air in front body portion 30 flows through tube 26 into fluid reservoir 24. The pressurized air that traveled through tube 26 is introduced into the sealed space between the inside of cup 48 and the outside of liner 52, and may be, for example, approximately 3 pounds per square inch to approximately 10 pounds per square inch. As a result, the pressure outside liner 52 is greater than the pressure inside liner 52, collapsing liner 52 upwards toward neck 22 and forcing, or pushing, paint contained within liner 52 up neck 22 and into paint channel 40 within gun body 28. Paint moving through paint channel 40 moves downstream through nozzle piece 64. Compression of trigger 42 and rearward movement, or retraction, of needle 38 also changes second valve 46 from a closed position to an open position. The paint driven from fluid reservoir 24 and through nozzle piece 64 mixes with the pressurized air upon exiting nozzle piece 64, at which time the paint is atomized. Paint is propelled out of spray gun 20 as an atomized spray. Spray cap 56 is adjustable to change the spray pattern coming from spray gun 20, such as between a fan spray pattern and a cone spray pattern.

Pressurized air in fluid reservoir 24 is used to drive paint from fluid reservoir 24 such that paint can exit nozzle piece 64 and combine with pressurized air from gun body 28 to spray paint from spray gun 20. Paint can be sprayed from spray gun 20 onto a target substrate.

Figure 3:
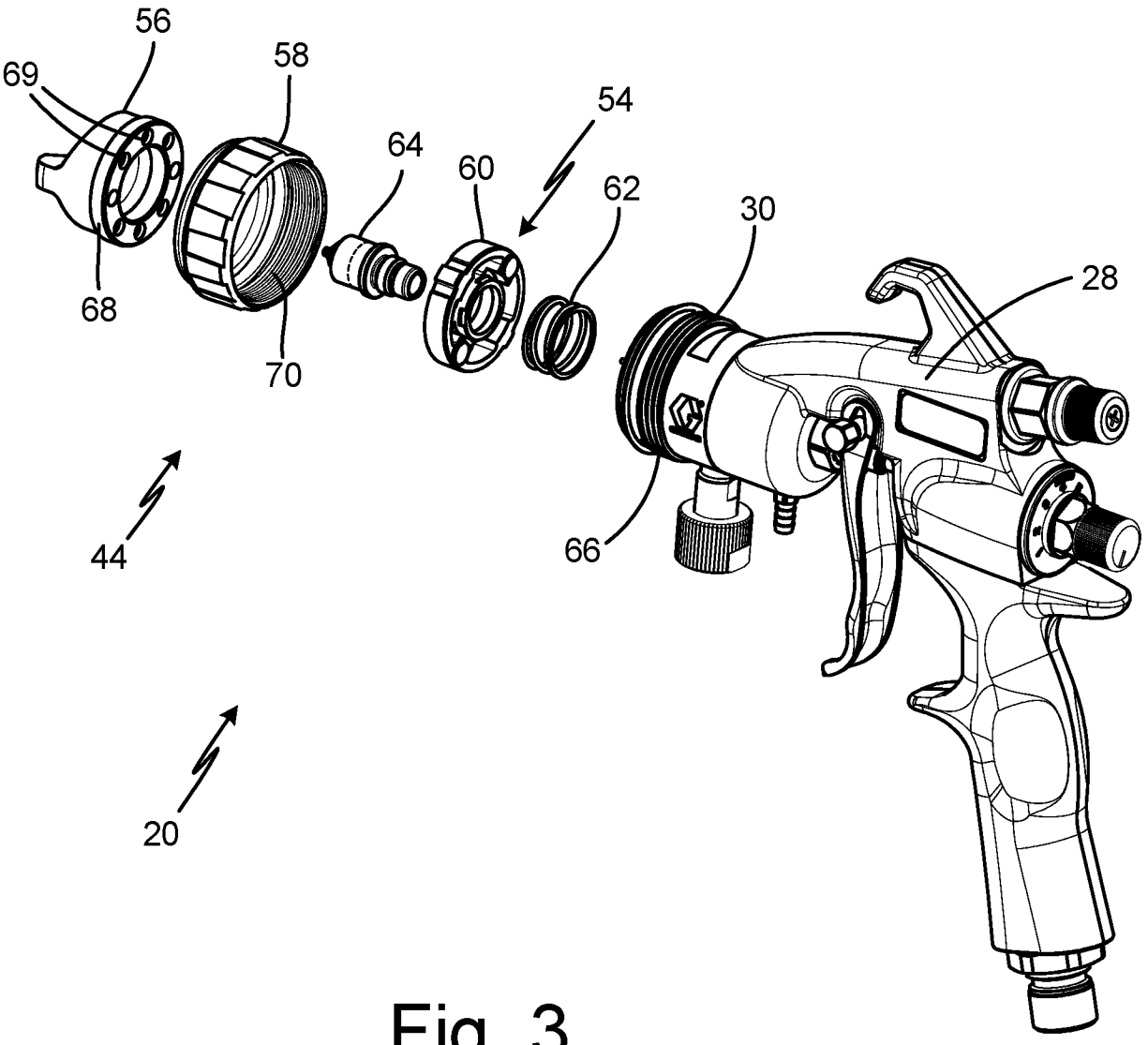
FIG. 3 is a partially exploded view of the spray gun showing the spray cap assembly.

FIG. 3 is a partially exploded view of spray gun 20 showing spray cap assembly 44. Spray gun 20 includes gun body 28 (which includes front body portion 30), spray cap assembly 44, and threading 66. Spray cap assembly 44 includes nozzle assembly 54, spray cap 56, and retaining ring 58. Nozzle assembly 54 includes air flow guide 60, spring 62, and nozzle piece 64. Spray cap 56 includes shoulder 68 and apertures 69. Retaining ring 58 includes threading 70.

Spray gun 20 is the same as described in reference to FIGS. 1 and 2. Threading 66 is on an exterior surface of front body portion 30 of gun body 28 near the front end of front body portion 30. Shoulder 68 is at a back end of spray cap 56. Shoulder 68 has a larger diameter than an inner diameter of a front end of retaining ring 58. Apertures 69 extend through spray cap 56 from a back end to a front end. Threading 70 is on an interior surface of retaining ring 58.

To assemble spray cap assembly 44 on spray gun 20, a front end of spring 62 is attached to a back end of air flow guide 60. Spring 62 and air flow guide 60 are positioned within front body portion 30 of gun body 28. Nozzle piece 64 is positioned to extend through central apertures of air flow guide 60 and spring 62 such that a back end of nozzle piece 64 is threaded into the front end of front body portion 30. Nozzle piece 64 secures air flow guide 60 and spring 62 to the front end of front body portion 30 when nozzle piece 64 is threaded into front body portion 30, thereby attaching nozzle assembly 54 to front body portion 30 of gun body 28. Nozzle piece 64 may be threaded into front body portion 30 by hand. Spray cap 56 is partially positioned in gun body 28 at the front end of front body portion 30 such that the back end of spray cap 56 contacts a front end of air flow guide 60. Spring 62 forces engagement between air flow guide 60 and spray cap 56. Retaining ring 58 is attached to front end of front body portion 30 via threading 70 interfacing and engaging with threading 66. Retaining ring 58 can be threaded onto front body portion 30 by hand. Retaining ring 58 secures, or attaches, spray cap 56 to front body portion 30. Spray cap 56 slides partially through an aperture in retaining ring 58 until shoulder 68 of spray cap 56 catches, or engages, the inner diameter of the aperture at the front end of retaining ring 58. Shoulder 68 engages retaining ring 58 when retaining ring 58 is screwed into front body portion 30. As such, shoulder 68 prevents spray cap 56 from sliding all of the way through the aperture in retaining ring 58 and entirely out of a front of retaining ring 58, thereby securing spray cap 56 to front body portion 30.

The degree to which retaining ring 58 is threaded onto front body portion 30 is variable to change the distance between spray cap 56 and nozzle assembly 54. The distance between spray cap 56 and nozzle assembly 54 changes the width of the spray pattern. For example, threading retaining ring 58 to a lesser degree leaves more space between spray cap 56 and nozzle assembly 54, resulting in a narrower fan pattern. As such, the degree to which spray cap 56 is positioned in or out of the front end of front body portion 30 is adjustable to achieve a desired spray pattern. Further, the relative orientation of spray cap 56 and air flow guide 60 is variable to change the orientation of apertures 69 relative to air flow guide 60. Changing the interaction between spray cap 56 and air flow guide 60 changes the airflow through spray cap 56. More specifically, changing the orientation of apertures 69 relative to air flow guide 60 changes the shape of the spray pattern. As such, the spray cap 56 is adjustable by rotating spray cap 56 relative to air flow guide 60 to achieve a desired spray pattern.

To disassemble spray cap assembly 44 from spray gun 20, retaining ring 58 is removed from the front end of front body portion 30 of gun body 28 by disengaging, or unscrewing, threading 70 and threading 66. When retaining ring 58 is removed, spray cap 56 becomes unsecured from the front of front body portion 30 and is removed from front body portion 30. However, in certain orientations, shoulder 68 remains engaged with the front end of retaining ring 58, allowing retaining ring 58 to continue to hold spray cap 56. More specifically, spray cap 56 extends partially through the aperture in retaining ring 58 and is blocked from sliding all of the way through the aperture in retaining ring 58 due to shoulder 68. When retaining ring 58 is unsecured from the front end of front body portion 30 and retaining ring 58 and spray cap 56 are removed from front body portion 30, nozzle assembly 54 remains fixed to front body portion 30 because nozzle piece 64 remains threaded into the front end of front body portion 30. As such, removal of retaining ring 58 and removal of spray cap 56 does not allow air flow guide 60 to be removed from front body portion 30. Nozzle piece 64 retains air flow guide 60 and spring 32 in front body portion 30. Nozzle piece 64 is unthreaded from the front end of front body portion 30 to remove nozzle assembly 54 from gun body 28. When nozzle assembly 54 is removed from gun body 28, nozzle piece 64, air flow guide 60, and spring 62 remain attached together.

A spray cap assembly may require disassembly on the jobsite to exchange, replace, and/or clean parts of the spray gun. For example, the spray cap assembly may be disassembled to change to a larger-sized nozzle piece 64 and needle 38 in order to achieve a spray pattern of a different size or configuration. Traditionally, the multiple parts of the spray cap assembly are unsecured and can fall as separate pieces during disassembly, causing user frustration and potentially damaging, dirtying, or losing the parts. For example, when the spray cap assembly is disassembled over a sink for cleaning, loose parts my fall down the drain and become lost. Specifically, the air flow guide and/or the spring may become unsecured and can fall separately when the nozzle piece is unthreaded, or even still threaded in some cases, to the front end of the front body portion of the gun body. For example, in a design in which the nozzle piece does not retain the air flow guide and the spring to the front body portion, the spray cap, the retaining ring, the nozzle piece, the air flow guide, and the spring could all become unsecured and fall as separate pieces when the retaining ring is unthreaded from the front body portion. Managing numerous loose components can be particularly problematic because a user is typically required to use both hands to unscrew the two threaded parts. Thus, both hands are occupied as the other parts become unsecure.

All of the parts of air cap assembly 44 do not fall out of front body portion 30 when retaining ring 58 is removed. Rather, retaining ring 58 captures spray cap 56 and nozzle piece 64 retains nozzle assembly 54, including air flow guide 60 and spring 62, in front body portion 30. Further, retaining ring 58 and nozzle piece 64 are easy to thread and unthread. Thus, disassembly of air cap assembly 44 is easier, more manageable, and can be accomplished without tools. As a result, spray cap assembly 44 reduces the likelihood of dropping and dirtying, damaging, and/or losing components of spray cap assembly 44 during disassembly, such as when switching out nozzle pieces 64 and needles 38.

Figure 4B:
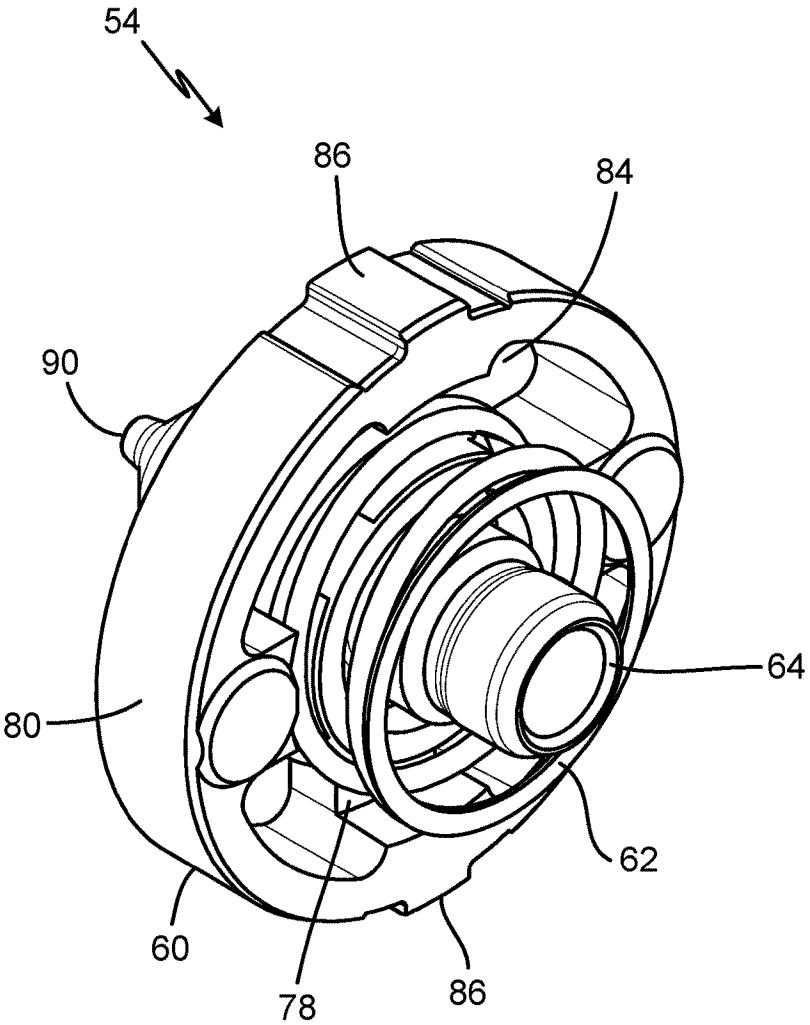
FIG. 4B is a rear isometric view of the nozzle assembly.
Figure 4A:
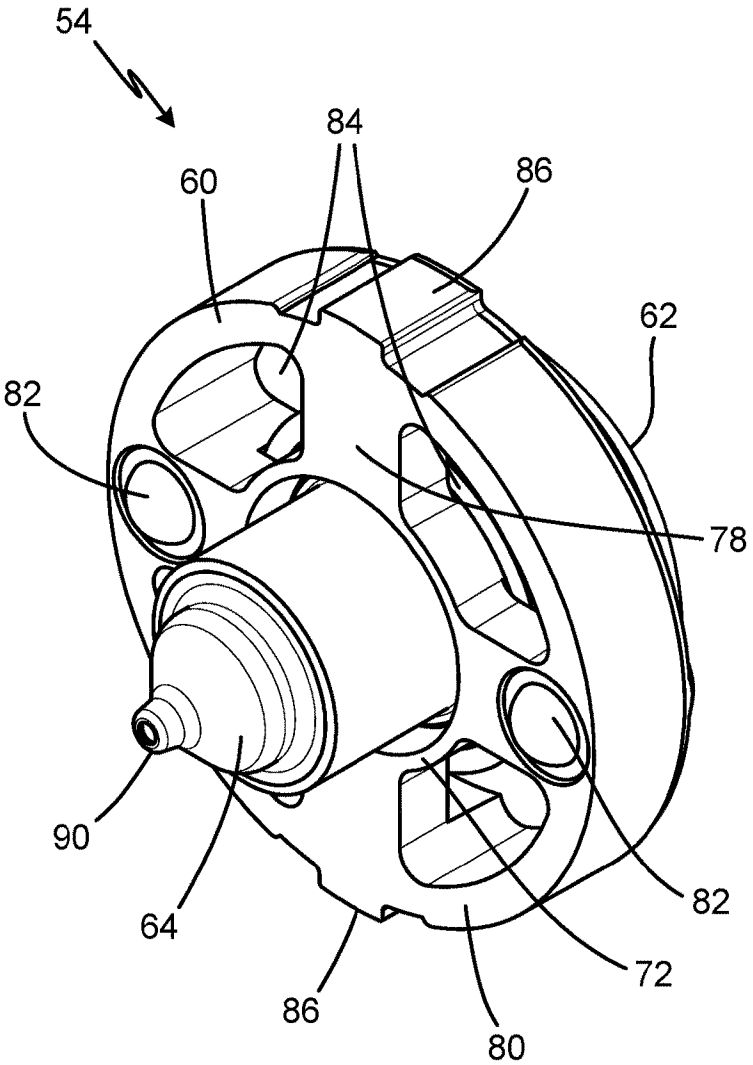
FIG. 4A is a front isometric view of a nozzle assembly of the spray gun.
Figure 4C:
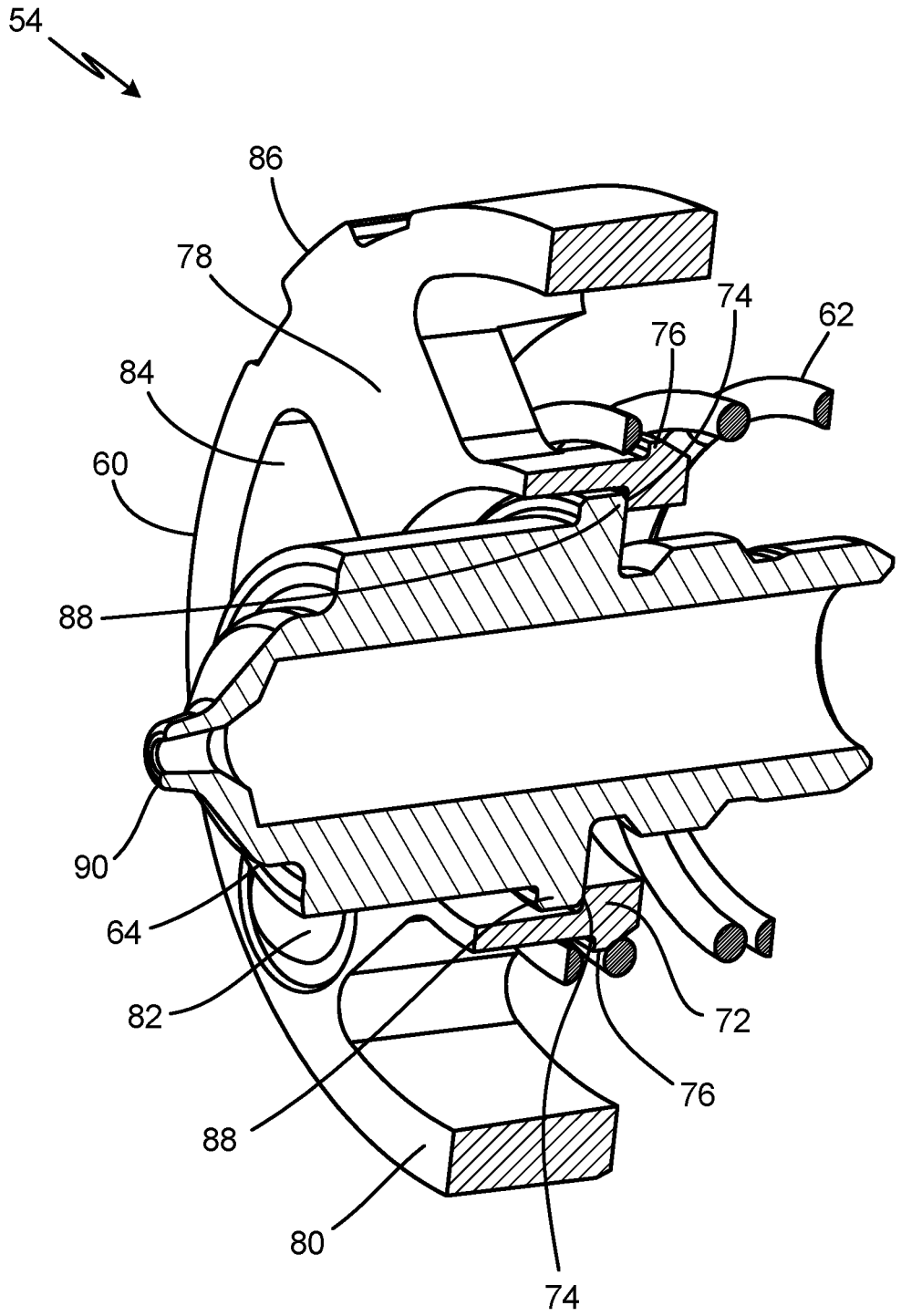
FIG. 4C is a cross-sectional view of the nozzle assembly.
Figure 4D:
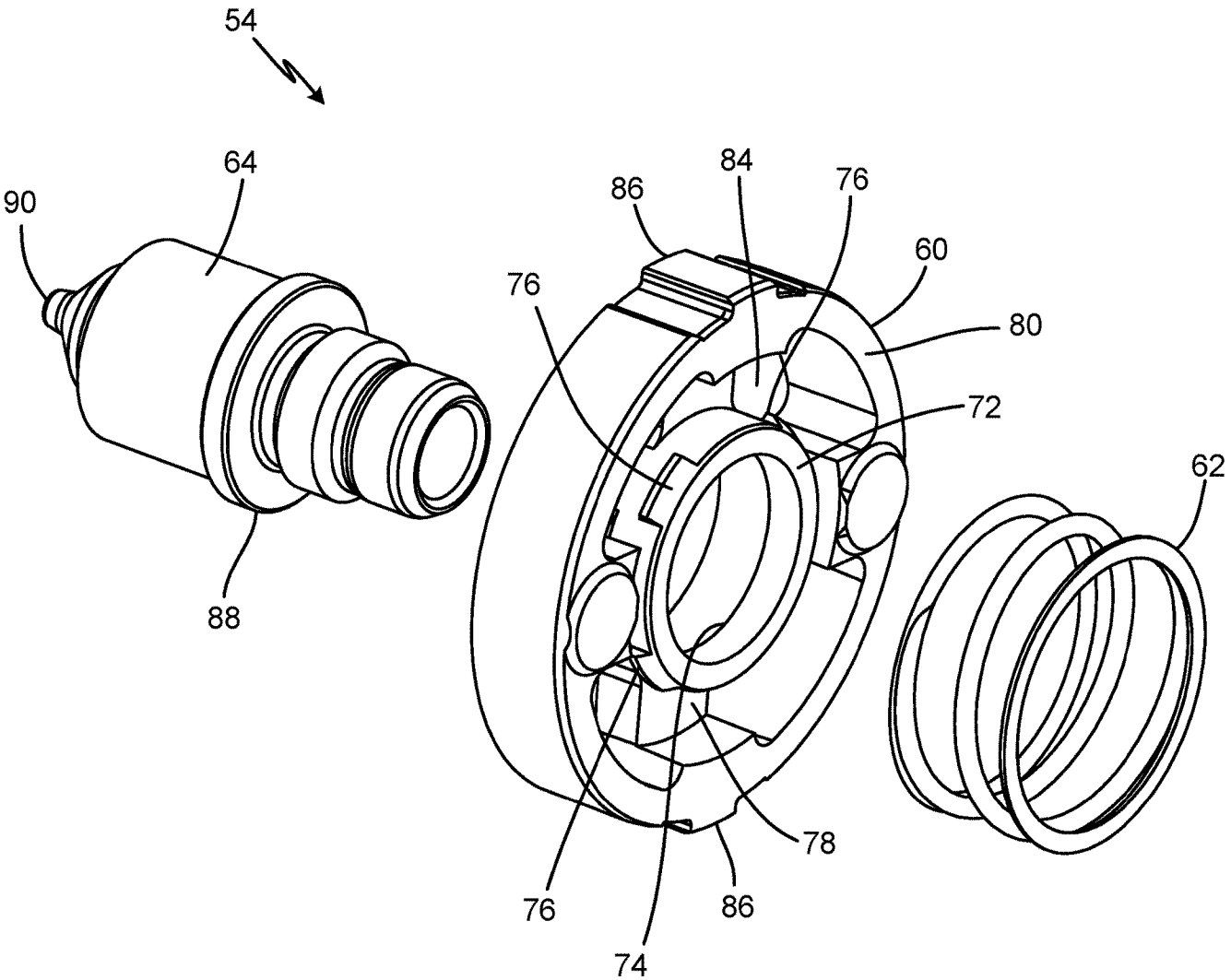
FIG. 4D is an isometric view of the nozzle assembly disassembled.

FIG. 4A is a front isometric view of nozzle assembly 54 of spray gun 20. FIG. 4B is a rear isometric view of nozzle assembly 54. FIG. 4C is a cross-sectional view of nozzle assembly 54. FIGS. 4A, 4B, and 4C show nozzle assembly 54 assembled. FIG. 4D is an isometric view of nozzle assembly 54 disassembled. FIGS. 4A, 4B, 4C, and 4D will be discussed together. Nozzle assembly 54 includes air flow guide 60, spring 62, and nozzle piece 64. Air flow guide 60 includes inner ring 72 (shown in FIGS. 4A, 4C, and 4D), shoulder 74 (shown in FIGS. 4C and 4D), tabs 76 (shown in FIGS. 4C and 4D), spokes 78, outer ring 80, ball detents 82 (FIGS. 4A and 4C), voids 84, and keys 86. Nozzle piece 64 includes protrusion 88 (shown in FIGS. 4C and 4D) and nozzle tip 90.

Nozzle assembly 54 is the same as described in reference to FIGS. 1-3. Inner ring 72 is at a center of air flow guide 60. An inner diameter of inner ring 72 defines a central aperture of air flow guide 60. Shoulder 74 is an annular flange located at a back portion of an interior of inner ring 72, forming a necked section. As such, shoulder 74 is at a back portion of the central aperture of air flow guide 60, and the back portion of the central aperture of air flow guide 60 has a smaller inner diameter than a front portion of the central aperture. Shoulder 74 is a retaining element of air flow guide 60. Tabs 76 are located on inner ring 72. More specifically, tabs 76 are tapered protrusions extending out of a back portion of an exterior of inner ring 72. Tabs 76 taper toward the back end of inner ring 72. A front portion of spring 62 is attached to the back portion of inner ring 72 of air flow guide 60 at tabs 76. Spokes 78 extend from an exterior of inner ring 72 to an interior of outer ring 80. An outer diameter of outer ring 80 makes up the outer diameter, or outer periphery, of air flow guide 60. Ball detents 82 are positioned partially within spokes 78 between inner ring 72 and outer ring 80. Ball detents 82 protrude from the front end of air flow guide 60. Voids 84 are spaces located between spokes 78 and between inner ring 72 and outer ring 80. Voids 84 extend entirely through air flow guide 60, from a back end to a front end of air flow guide 60. Keys 86 are shapes formed on the outer periphery, or outer diameter, of outer ring 80. As such, keys 86 make up a portion of the outer periphery of air flow guide 60 and have a larger outer diameter than outer ring 80. Keys 86 are complementary to inverse key shapes on an inside of the front end of front body portion 30.

Protrusion 88 is an annular flange extending from an exterior of nozzle piece 64. Protrusion 88 fits inside the central aperture of air flow guide 60 defined by inner ring 72, but is wider, or larger in outer diameter, than the inner diameter of the central aperture of air flow guide 60 at shoulder 74. Protrusion 88 is a retaining element of nozzle piece 64. Protrusion 88 interfaces, or engages, with shoulder 74. Nozzle tip 90 is located at the front of nozzle piece 64. Nozzle piece 64, and more particularly nozzle tip 90 of nozzle piece 64, is the last part of spray gun 20 that fluid paint contacts during release of the fluid as a spray.

Nozzle assembly 54 can be assembled by removably attaching spring 62 to air flow guide 60. A front end of spring 62 fits around tabs 76 to releasably secure spring 62 to air flow guide 60. When the front end of spring 62 is fit onto inner ring 72 of air flow guide 60, the front winding of spring 62 passes over tabs 76 and snaps onto air flow guide 60, preventing spring 62 from moving backward. The front end of spring 62 contacts spokes 78, preventing spring 62 from moving forward. Thus, air flow guide 60 and attached spring 62 can be positioned in the front end of front body portion 30 as a single piece. The position of air flow guide 60 within front body portion is determined by keys 86. In order to place air flow guide 60 inside front body portion 30, air flow guide 60 must be positioned such that keys 86 on air flow guide 60 match up to corresponding keys on the inside of the front end of front body portion 30.

Nozzle piece 64 is partially threaded into the front of front body portion 30 such that nozzle piece 64 is partially positioned in the central apertures of air flow guide 60 and spring 62. Because protrusion 88 of nozzle piece 64 is larger in outer diameter than the inner diameter of the central aperture of air flow guide 60 at shoulder 74, protrusion 88 of nozzle piece 64 contacts shoulder 74 of air flow guide 60. The engagement of protrusion 88 of nozzle piece 64 and shoulder 74 of air flow guide 60 prevents air flow guide 60 from moving forward of, or moving past, nozzle piece 64. Protrusion 88 interfaces with shoulder 74 to retain air flow guide 60 and spring 62 in front body portion 30 when nozzle piece 64 is threaded into front body portion 30. As such, air flow guide 60 and nozzle piece 64 are dimensioned such that air flow guide 60 cannot slide over, or move past, nozzle piece 64. In alternate embodiments, protrusion 88 may snap into a recess or detent within the central aperture of air flow guide 60.

After air flow guide 60 is received within the front end of front body portion 30 (as shown in FIG. 3), keys 86 prevent rotation of air flow guide 60 relative to the front end of front body portion 30. Preventing rotation of air flow guide 60 is beneficial to maintaining proper alignment of air flow guide 60 and spray cap 56 (shown in FIG. 3). Rotation of spray cap 56 changes the alignment of apertures 69 and voids 84. Voids 84 allow air to flow past air flow guide 60 through voids 84. The degree of alignment, or relative orientation, of spray cap 56 and voids 84 of air flow guide 60 shapes the spray pattern in different ways. For example, rotating spray cap 56 relative to air flow guide 60 aligns or misaligns voids 84 with various apertures 69 at the back end of spray cap 56. Rotation of spray cap 56 also changes the alignment of apertures 69 and spokes 78. The relative orientation of spray cap 56 and spokes 78 may cause spokes 78 to block apertures 69, preventing air from flowing through apertures 69. Apertures 69 route the pressurized air through spray cap 56 to shape the spray pattern exiting spray cap 56. A first relative orientation between spray cap 56 and air flow guide 60 sprays a cone spray pattern, a second relative orientation between spray cap 56 and air flow guide 60 sprays a vertically-oriented fan spray pattern, and a third relative orientation between spray cap 56 and air flow guide 60 sprays a horizontally-oriented fan spray pattern.

Ball detents 82, included in air flow guide 60, engage with apertures 69 on the back side of spray cap 56 (shown in FIG. 3) to toggle the relative positions of spray cap 56 and air flow guide 60. Spring 62 pushes air flow guide 60 forward so that air flow guide 60 maintains contact with the back end of spray cap 56. Spring 62 also allows spray cap 56 and air flow guide 60 to be moved backwards and rotated when the spring force of spring 62 is overcome, such as by manual adjustment, to change the spray pattern. For example, retaining ring 58 may be rotated to decrease the distance between spray cap 56 and nozzle assembly 54, or spray cap 56 may be rotated to achieve a desired spray pattern.

When spray cap 56 is removed during disassembly of spray cap assembly 44, air flow guide 60 and spring 62 are prevented from falling out of spray gun 20, because air flow guide 60 cannot move forward of, or slide over, nozzle piece 64. As such, nozzle piece 64 retains air flow guide 60 and spring 62 in front body portion 30 of gun body 28. When nozzle piece 64 is unthreaded from the front end of front body portion 30 (shown in FIG. 3) of gun body 28 (shown in FIG. 2), air flow guide 60 and spring 62 become unsecured from the front end of front body portion 30. However, as shown in FIGS. 4A-4C, nozzle piece 64, air flow guide 60, and spring 62 are retained together as a single piece, nozzle assembly 54, as nozzle piece 64 is removed from the front end of front body portion 30. Protrusion 88 retains air flow guide 60 and spring 62 when nozzle piece 64 is unthreaded from front body portion 30 and held in certain orientations. A user holding onto an outside surface of nozzle piece 64 (which may be knurled to suggest and promote the surface as a grip) prevents air flow guide 60 and spring 62 from sliding off nozzle piece 64, particularly by holding nozzle assembly 54 with a front end of nozzle piece 64 oriented downward toward the ground. As such, nozzle piece 64, air flow guide 60, and spring 62 are removable from front body portion 30 as a single unit, nozzle assembly 54, and can be held as a single unit.

Nozzle assembly 54 can be disassembled. Nozzle piece 64 can be removed from air flow guide 60 and spring 62 by moving air flow guide 60 backwards relative to nozzle piece 64, or moving nozzle piece 64 forward, so that nozzle piece 64 is entirely out of the central aperture of air flow guide 60. Removing nozzle piece 64 can also be accomplished by orienting nozzle assembly 54 with the front end of nozzle piece oriented upward so that air flow guide 60 and spring 62 slide off nozzle piece 64. Spring is prevented from moving forward of air flow guide 60 because tabs 76 releasably lock spring 62 to air flow guide 60, and spokes 78 serve as a forward stop to the front end of spring 62. As such, spring 62 remains connected to air flow guide 60 after nozzle piece 64 is removed. However, spring 62 can be moved backward to overcome tabs 76 and unsnap the front winding of spring 62 from tabs 76, disengaging spring 62 from air flow guide 60. As such, spring 62 and air flow guide 60 are disassembled.

Preventing air flow guide 60 from rotating allows for proper orientation of spray cap 56 relative to air flow guide 60 such that adjustments of spray cap 56 result in known spray patterns, making spray pattern adjustment easier for a user. Further, because nozzle piece 64, air flow guide 60, and spring 62 can be secured together, the components of nozzle assembly 54 remain joined as one piece when removed from front body portion 30 and/or spray cap assembly 44. As such, the components of nozzle assembly 54 do not fall as separate unconnected pieces during disassembly of spray gun 20 and/or spray cap assembly 44. Additionally, disassembly of air flow guide 60, spring 62, and nozzle piece 64 making up nozzle assembly 54 is quick and easy. Moreover, the entire assembly and disassembly of nozzle assembly 54, and of spray cap assembly 44, can be performed without tools and simply via unthreading. As a result, disassembly of spray cap assembly 44 is easier to disassemble for replacing or cleaning parts of the spray gun.

While paint has been used as an example of fluid sprayed from spray gun 20, other fluids (e.g. water, oil, stains, finishes, coatings, solvents, and solutions) can be sprayed instead of paint.

Discussion of Possible Embodiments

The following are non-exclusive descriptions of possible embodiments of the present invention.

A spray gun of a high-volume low-pressure spray system comprising: a gun body having a front body portion; and a spray cap assembly attached to the front body portion of the gun body, the spray cap assembly comprising: a nozzle assembly including: a nozzle piece partially positioned in the front body portion of the gun body; an air flow guide surrounding the nozzle piece and located in the front body portion; and a spring attached to the air flow guide; and a spray cap positioned over the nozzle assembly and removably attached to the front body portion; wherein the spring and the air flow guide remain attached and are removed together from the front body portion of the gun body.

The spray gun of the preceding paragraph can optionally include, additionally and/or alternatively, any one or more of the following features, configurations and/or additional components:

The spring is removably attached to the air flow guide.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A spray gun comprising:

a gun body having a front body portion; and a spray cap assembly attached to the front body portion of the gun body, the spray cap assembly comprising:

a nozzle assembly including:

a nozzle piece configured to attach to the front body portion of the gun body and including a protrusion extending from an exterior of the nozzle piece;

an air flow guide surrounding the nozzle piece and including a shoulder at a central aperture of the air flow guide, wherein the shoulder is configured to engage the protrusion to prevent the air flow guide from moving past the nozzle piece; and a spring removably attached to tabs extending radially from the air flow guide, wherein the spring is concentrically disposed relative to the air flow guide; and a spray cap that interfaces with the air flow guide and is positioned over the nozzle assembly;

wherein the air flow guide is configured to engage with the nozzle piece so that the air flow guide is prevented from moving past the nozzle piece, and the spring is configured to force engagement between the air flow guide and the spray cap.

2. The spray gun of claim 1, wherein the spray cap is removable from the front body portion of the gun body to expose the nozzle assembly attached to the front body portion of the gun body.

3. A spray cap assembly for use with a spray gun having a front body portion, the spray cap assembly comprising:

a nozzle assembly including:

a nozzle piece configured to attach to the front body portion, the nozzle piece including a protrusion extending from an exterior of the nozzle piece; and an air flow guide surrounding the nozzle piece, the air flow guide including a shoulder at a central aperture of the air flow guide; and a spray cap that interfaces with the air flow guide and is positioned over the nozzle assembly;

wherein the shoulder of the air flow guide is configured to engage with the protrusion of the nozzle piece so that the air flow guide is prevented from moving entirely past the nozzle piece; and wherein the nozzle piece is configured to thread into the front body portion to retain the nozzle piece, the air flow guide, and a spring in the front body portion, the spring being removably attached to tabs extending radially from an inner ring of the air flow guide.

4. The spray gun of claim 1, wherein the nozzle assembly is removable from the front body portion of the gun body as a unit.

5. The spray gun of claim 1, wherein the spring is removable from the air flow guide to allow disassembly of the nozzle assembly.

6. The spray gun of claim 5, wherein the spring is attached to tabs extending out of an inner ring of the air flow guide.

7. A spray gun comprising:

a gun body having a front body portion; and a spray cap assembly attached to the front body portion of the gun body, the spray cap assembly comprising:

a nozzle assembly including:

a nozzle piece configured to attach to the front body portion of the gun body, the nozzle piece being partially positioned in the front body portion of the gun body;

an air flow guide surrounding the nozzle piece, the air flow guide being located in the front body portion, wherein the air flow guide is configured to engage with the nozzle piece so that the air flow guide is prevented from moving entirely past the nozzle piece; and a spring removably attached to the air flow guide, wherein the spring is concentrically disposed relative to the air flow guide and removably attached to tabs extending radially from the air flow guide; and a spray cap that interfaces with the air flow guide and is positioned over the nozzle assembly, wherein the spray cap is removably attached to the front body portion and removal of the spray cap alone does not allow the air flow guide to be removed from the front body portion of the gun body.

8. The spray gun of claim 7, wherein the spring is configured to force engagement between the air flow guide and the spray cap.

9. The spray gun of claim 8, wherein the nozzle assembly is removable from the front body portion of the gun body as a unit.

10. The spray gun of claim 7, wherein a retaining element engages the air flow guide to prevent the air flow guide from moving forward of the nozzle piece.

11. The spray gun of claim 10, wherein the retaining element is a protrusion extending from an exterior of the nozzle piece that engages a shoulder at a central aperture of the air flow guide to prevent the air flow guide from moving past the nozzle piece.

12. The spray gun of claim 11, wherein the protrusion is an annular flange larger in outer diameter than an inner diameter of the central aperture of the air flow guide at the shoulder.

13. The spray gun of claim 11, wherein the air flow guide is retained in the front body portion when the nozzle piece is threaded into the front body portion.

14. The spray gun of claim 11, wherein the air flow guide is prevented from moving past the nozzle piece when the nozzle piece is threaded in the front body portion of the gun body and when the nozzle piece is unthreaded from the front body portion of the gun body.

15. A method for disassembling a spray cap assembly, the spray cap assembly comprising a gun body having a front body portion, and a spray cap assembly attached to the front body portion of the gun body, the spray cap assembly comprising a nozzle assembly including a nozzle piece configured to attach to the front body portion of the gun body, an air flow guide surrounding the nozzle piece, and a spring removably attached to the air flow guide and concentrically disposed relative to the air flow guide, the spray cap assembly further comprising a spray cap that interfaces with the air flow guide and that is positioned over the nozzle assembly, the air flow guide configured to engage with the nozzle piece so that the air flow guide is prevented from moving past the nozzle piece, and the spring is configured to force engagement between the air flow guide and the spray cap, the method comprising:

removing a retaining ring from the front body portion of the gun body of the spray gun; and removing the spray cap from the front body portion of the gun body while leaving the nozzle piece retained to the gun body, wherein the nozzle piece also retains the air flow guide to the gun body.

16. The method of claim 15, further including unsecuring the nozzle piece from the gun body, which also unsecures the air flow guide from the gun body.

17. The method of claim 16, wherein unsecuring the nozzle piece from the gun body includes unthreading the nozzle piece from the front body portion of the gun body to remove the nozzle piece, the air flow guide, and the spring from the front body portion as a unit.

18. The method of claim 17, further including disengaging the spring from the air flow guide.

19. The method of claim 15, wherein the nozzle piece, the air flow guide, and the spring are retained in the front body portion of the gun body when the nozzle piece is partially threaded into the front body portion.

* * * * *